US011291237B2

(12) United States Patent
Rushforth et al.

(10) Patent No.: US 11,291,237 B2
(45) Date of Patent: Apr. 5, 2022

(54) CONTAINER COMPRISING A FIRST CHAMBER AND A SECOND CHAMBER

(71) Applicant: BRITISH AMERICAN TOBACCO (INVESTMENTS) LIMITED, London (GB)

(72) Inventors: David Rushforth, London (GB); Paul Gibson, London (GB); Eva Sommarstrom, London (GB)

(73) Assignee: British American Tobacco (Investments) Limited, London (GB)

( * ) Notice: Subject to any disclaimer, the term of this patent is extended or adjusted under 35 U.S.C. 154(b) by 489 days.

(21) Appl. No.: 14/785,598

(22) PCT Filed: Apr. 15, 2014

(86) PCT No.: PCT/GB2014/051167
§ 371 (c)(1),
(2) Date: Oct. 19, 2015

(87) PCT Pub. No.: WO2014/170652
PCT Pub. Date: Oct. 23, 2014

(65) Prior Publication Data

US 2016/0073679 A1 Mar. 17, 2016

(30) Foreign Application Priority Data

Apr. 18, 2013 (GB) ..... 1307016

(51) Int. Cl.
*A24B 15/28* (2006.01)
*B65D 51/28* (2006.01)
(Continued)

(52) U.S. Cl.
CPC ..... *A24B 15/282* (2013.01); *A24F 23/00* (2013.01); *B65D 51/28* (2013.01); *B65D 81/22* (2013.01); *B65D 2209/00* (2013.01)

(58) Field of Classification Search
CPC ..... B65D 81/22; A24F 23/00
(Continued)

(56) References Cited

U.S. PATENT DOCUMENTS 314,223 A * 3/1885 Clark ..... A24F 25/02 312/31
430,643 A * 6/1890 Hamm ..... A24F 25/02 312/31.1
(Continued)

FOREIGN PATENT DOCUMENTS

CA 2198329 A1 9/1997
EP 0531075 A1 3/1993
(Continued)

OTHER PUBLICATIONS

European Patent Office, "International Search Report" issued in connection to International Application No. PCT/GB2014/051167, dated Jun. 24, 2014, 5 pages. Jun. 24, 2014.

*Primary Examiner* — Kelly M Gambetta
*Assistant Examiner* — Russell E Sparks
(74) *Attorney, Agent, or Firm* — McKee, Voorhees & Sease, PLC

(57) ABSTRACT

A container is disclosed which has a first chamber and a second chamber separated by a wall. The separating wall is configured so that at least one substance emitted by a donor product received in the second chamber is conveyed from the second chamber into the first chamber through said separating wall. In this way, a characteristic of the donor product is imparted to a recipient product in said first chamber.

15 Claims, 6 Drawing Sheets

(51) Int. Cl.
*A24F 23/00* (2006.01)
*B65D 81/22* (2006.01)

(58) Field of Classification Search
USPC ..... 131/310
See application file for complete search history.

(56) References Cited

U.S. PATENT DOCUMENTS

| | | | | | |
|---|---|---|---|---|---|
| 1,145,915 | A * | 7/1915 | Marcuse | A24F 25/02 | 312/31.1 |
| 1,472,478 | A * | 10/1923 | Kreh | A24F 25/02 | 312/31.2 |
| 1,540,484 | A * | 6/1925 | Larsen | A24F 25/02 | 239/55 |
| 1,676,683 | A * | 7/1928 | Brunhoff | A24F 25/02 | 312/31.1 |
| 1,858,864 | A * | 5/1932 | Podel | B65D 41/16 | 215/317 |
| 1,935,840 | A | 11/1933 | Fitzgerald | | |
| 2,051,777 | A * | 8/1936 | Purinton | A24F 25/02 | 206/204 |
| 2,587,726 | A * | 3/1952 | Holder | B65D 25/04 | 220/532 |
| 4,098,421 | A * | 7/1978 | Foster | B65D 41/18 | 215/321 |
| 4,577,080 | A | 3/1986 | Grossman | | |
| 5,230,867 | A | 7/1993 | Kunze et al. | | |
| 5,829,452 | A | 11/1998 | Oster | | |
| 5,938,012 | A * | 8/1999 | Yeager | A24F 25/02 | 206/205 |
| 7,841,586 | B1 | 11/2010 | Mongeon et al. | | |
| 8,869,980 | B2 * | 10/2014 | Berggren | A24F 23/04 | 206/256 |
| 9,532,596 | B2 * | 1/2017 | Takeuchi | B65D 81/3238 | |
| 2005/0244548 | A1 | 11/2005 | Cheng | | |
| 2007/0127853 | A1 | 6/2007 | Bezek et al. | | |
| 2008/0210249 | A1 | 9/2008 | Luzenberg | | |
| 2009/0008391 | A1 | 1/2009 | Bjorkholm | | |
| 2009/0014343 | A1 * | 1/2009 | Clark | A24F 23/00 | 206/247 |
| 2010/0018882 | A1 * | 1/2010 | St. Charles | B65D 51/28 | 206/242 |
| 2010/0037780 | A1 | 2/2010 | Pas et al. | | |
| 2011/0073607 | A1 | 3/2011 | Fu et al. | | |
| 2011/0284400 | A1 * | 11/2011 | Gibson | A24F 23/00 | 206/216 |
| 2012/0031414 | A1 * | 2/2012 | Atchley | A24B 13/00 | 131/118 |
| 2012/0168329 | A1 | 7/2012 | Berggren | | |
| 2012/0325698 | A1 | 12/2012 | Hermans | | |
| 2016/0058069 | A1 | 3/2016 | Rushforth et al. | | |
| 2016/0073680 | A1 | 3/2016 | Rushforth et al. | | |
| 2016/0073681 | A1 | 3/2016 | Rushforth et al. | | |

FOREIGN PATENT DOCUMENTS

| | | | |
|---|---|---|---|
| EP | 0615921 | A1 | 9/1994 |
| EP | 2236433 | B1 | 10/2010 |
| EP | 2236433 | B1 | 5/2012 |
| EP | 2543610 | A1 | 1/2013 |
| JP | 2001301758 | A | 10/2001 |
| JP | 200219853 | A | 1/2002 |
| JP | 201162189 | A | 3/2011 |
| JP | 2011062189 | A | 3/2011 |
| WO | WO199828995 | A1 | 7/1998 |
| WO | WO199944916 | A1 | 9/1999 |
| WO | 2004034819 | A1 | 4/2004 |
| WO | WO2008148702 | A1 | 12/2008 |
| WO | 2010060845 | A1 | 6/2010 |
| WO | 2010066510 | A1 | 6/2010 |
| WO | WO2011042171 | A1 | 4/2011 |
| WO | 2011096257 | A1 | 8/2011 |
| WO | WO2011139026 | A2 | 11/2011 |

* cited by examiner

CONTAINER COMPRISING A FIRST CHAMBER AND A SECOND CHAMBER

CROSS-REFERENCE TO RELATED APPLICATIONS

This application is the National Stage of international Application No. PCT/GB2014/051167, filed Apr. 15, 2014, which claims priority to and benefit of Great Britain Patent Application No. 1307016.4, filed Apr. 18, 2013.

FIELD

This invention relates to a container, specifically but not exclusively to a container for a snus smokeless tobacco product.

BACKGROUND

Snus tobacco may be sold either in loose form or in portions disposed in permeable bags and is packaged in portable containers having a re-closable lid to maintain the moisture of the snus during transport, storage and display of the product. Snus is typically consumed by placing it under the upper lip for an extended period of time.

SUMMARY

In accordance with embodiments of the invention, there is provided a container comprising a first chamber and a second chamber separated by a wall, the separating wall being configured so that at least one substance emitted by a donor product received in the second chamber is conveyed from the second chamber into the first chamber through said separating wall to impart a characteristic to a recipient product in said first chamber.

In one embodiment, the separating wall may comprise at least one opening through which the substance is conveyed.

In another embodiment, the separating wall may comprise a permeable or semi-permeable membrane through which the substance is conveyed.

The container may be formed of a body with two openings, the separating wall extending within the body to divide a space within the body into the first and second chambers.

The first chamber and the second chamber may each have one opening and a main lid may be attachable to one opening of the body to close the first chamber and a secondary lid may be attachable to another opening of the body to close the second chamber.

The container may comprise a base wall and an upstanding side wall to which a main lid can be removably attached to enclose the first chamber, said base wall may comprise a recess that protrudes into the first chamber.

A wall of the recess may be the separating wall and a secondary lid may be removably attachable to enclose the space within the recess and define the second chamber therein.

The second chamber may be defined in a space between the recess and the side wall of the container and the separating wall may extend across the space between the recess and the side wall of the container.

The recess in the base wall may be a disposal chamber.

The container may comprise a base wall and an upstanding side wall to which a main lid is removably attachable, the first chamber being defined in a space within the main body, and wherein the main lid may have a recess that, when the lid is attached to the container, protrudes into the first chamber and the second chamber is defined within said recess, a wall of the recess being the separating wall.

The recess in the main lid may comprise the second chamber and a disposal chamber and a dividing wall that separates the disposal chamber from the second chamber within the recess.

The container may further comprise a secondary lid that includes a protrusion configured such that when the secondary lid is attached to the container the protrusion extends either into the disposal chamber or into the second chamber.

The second chamber may comprise a plurality of sub-chambers.

The separating wall may be cylindrical and extend through the first chamber, the second chamber being defined within the cylindrical separating wall.

The container may comprise a removable cartridge within which the second chamber is defined, said cartridge may be attachable to the container such that the second chamber in the cartridge can communicate with the first chamber within the container.

The first chamber may contain one or more recipient products.

The second chamber may contain one or more donor products.

The recipient product may be a tobacco product.

The recipient product may be a snus tobacco product.

The substance emitted by the donor product may be a sensate substance to impart an organoleptic characteristic to a recipient product in the container.

The substance emitted by the donor product may be a moisturising substance to provide moisture to a recipient product in the container.

The donor product may be a non-tobacco organic substance.

In accordance with embodiments of the invention, there is also provided a method of imparting a characteristic to a recipient product stored in a first chamber of a container, the method including the step of providing the container with a second chamber separated from the first chamber by a wall and configuring the wall so that at least one substance emitted by a donor product received in the second chamber is conveyed from the second chamber into the first chamber through said wall to impart a characteristic to said recipient product.

In accordance with embodiments of the invention, there is also provided a cartridge for attachment to a container, wherein said cartridge comprises a second chamber that is configured to communicate with a first chamber in said container when said cartridge is attached to said container, so that at least one substance emitted by a donor product received in the second chamber is conveyed from the second chamber into said first chamber to impart a characteristic to a recipient product in said first chamber.

BRIEF DESCRIPTION OF THE DRAWINGS

Embodiments of the invention will now be described, by way of example only. With reference to the accompanying drawings, in which.

DESCRIPTION

The containers described with reference to the drawings expose a snus product received in the container, such as loose snus tobacco or snus pouches, to a donor product such as aromatic botanicals and/or other flavour/aroma ingredients for a period of time within the container, after packaging. In this way, volatile flavour/aroma components from the donor product may homogenize with the snus product during storage, transport and/or sales display so that the consumer is presented with a snus product freshly provided with the flavour volatiles. Alternatively, the consumer themselves may activate the process of homogenization of aroma volatiles between the donor product and the snus product once the product has been purchased.

These fresh characteristics, imparted to the snus product post-packaging, are preferable because the intensity and affect of the donor product are not diminished during storage, transport and shelf-life and after initial opening of the container. It also helps combat any change in the characteristics of the snus product that occur due to aging. By allowing consumers to select different donor products and different combinations of donor products, consumers are able to select what characteristic(s) to impart on the snus products.

Figure 1:
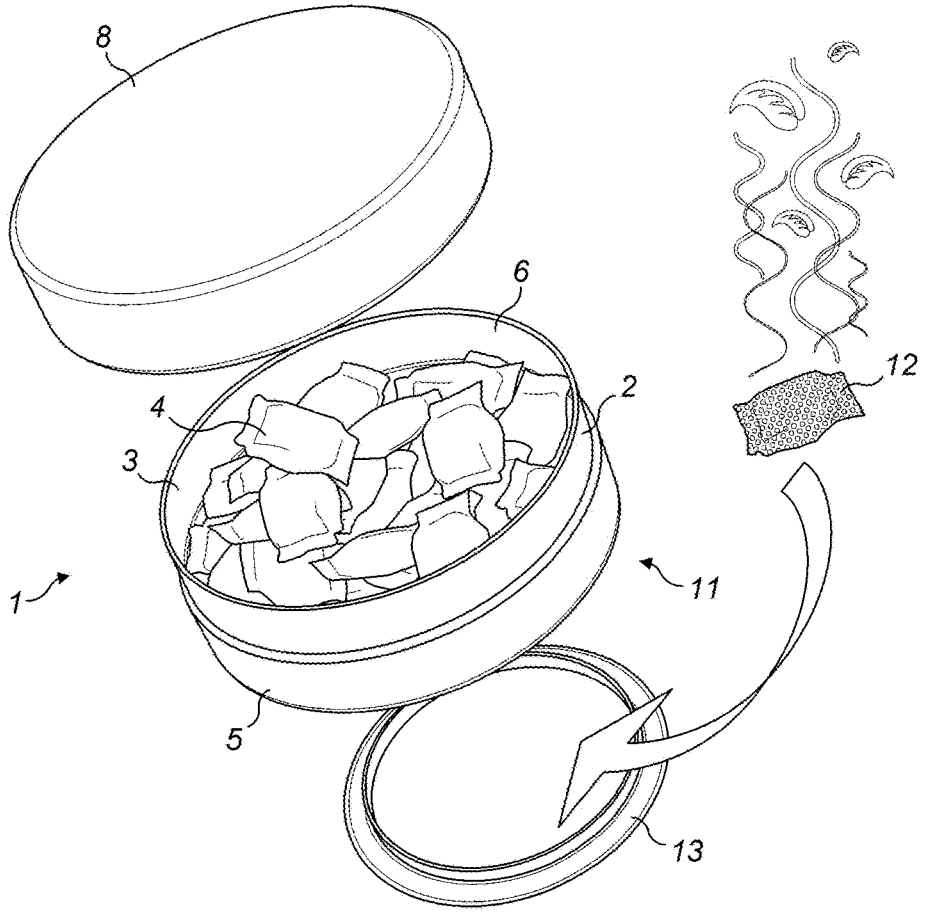
FIG. 1 shows a container for snus tobacco having a second chamber for a donor product.
Figure 2:
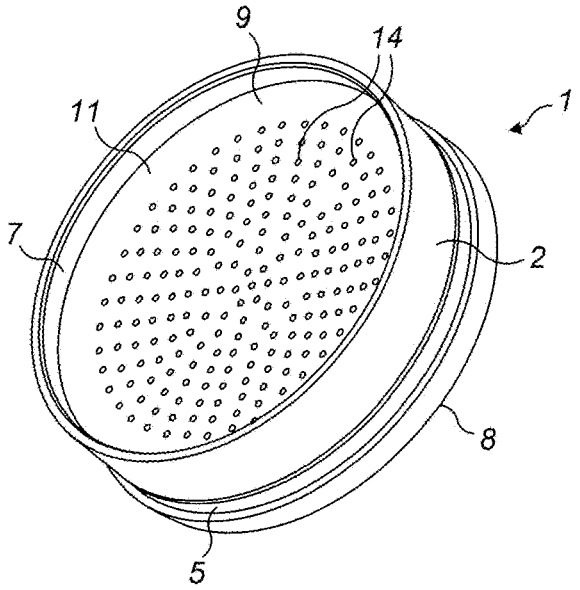
FIG. 2 shows a bottom view of the container of FIG. 1.

FIGS. 1 and 2 show a container 1 for snus products having a cylindrical main body 2 with a first chamber 3 for receiving a snus product, for example, FIG. 1 shows snus pouches 4 within the first chamber 3. The main body 2 of the container 1 is circular and may be pocket-sized, for the convenience of a consumer. The main body 2 comprises a cylindrical side wall with two openings—a first opening 6 at one end of the main body 2 and a second opening 7 at the opposite end of the main body 2. The first chamber 3 is defined within the space within the cylindrical side wall 5. The circular end 6 of the first chamber 3 is open to give access to the first chamber 3 and the snus products 4. The first chamber 3 is closed by a main lid 8 which removably attaches to the main body 2 over the first open end 6. The main lid 8 may push fit onto the body 2 and be retained by friction fit. Alternatively the lid 8 may threadingly engage with the body 2. Alternatively, any other suitable removable attachment means may be used.

As shown in FIG. 2, a separating wall 9 extends across the internal space between the two ends 6, 7 of the main body 2 to separate the first chamber 3 from a second chamber 11.

The second chamber 11 is for receiving a donor product, for example a volatile aromatic sensate substance, which may be contained in a porous bag or be in a loose form or in any other form that allows the donor product to release volatile aromas. The example of FIG. 1 shows an aromatic pouch 12 being inserted into the second chamber 11. The aromatic pouch 12 will be formed of a permeable web that contains the donor product and allows volatiles from the donor product to permeate the bag.

In the example shown in FIGS. 1 and 2, the second chamber 11 is circular and defined by the extent of the cylindrical side wall 5 of the main body 2 and the separating wall 9. A secondary lid 13 sealably closes the second chamber 11 and is removably attachable to the main body 2 by a push fit. Alternatively, the secondary lid 13 may be removably attachable to the main body 2 by means of a thread or other suitable attachment means.

The first and second chambers 3, 11 of the container 1 of FIG. 1 and FIG. 2 are formed opposite each other within the main body 2 of the container 1. The first chamber 3 may occupy a larger space within the body 2 than the second chamber 11 so that the container 1 can hold more snus product 4 than donor product 12.

The separating wall 9 that extends across the space within the cylindrical main body 2 to separate the first chamber 3 from the second chamber 11 is configured to prevent snus product 4 passing into the second chamber 11 and prevent the donor product 12 from passing into the first chamber 3. However, the wall 9 has a plurality of openings 14 that allow the first and second chambers 3, 11 to communicate, thereby allowing a sensate substance emitted from the donor product 12 to homogenize between the first and second chambers 3, 11 and therefore between the donor product 12 and the snus product 4. The sensate substance emitted from the donor product 12 in the second chamber 11 passes through the openings 14 in the separating wall 9 and infuses with the snus product 4 in the first chamber 3. The donor product 12 may emit aromatic vapours, liquids or similar sensate substances that pass through the openings 14 in the separating wall 9 into the first chamber and impart a characteristic, such as flavour or aroma, on the snus product 4. The sensate substance will impart a characteristic on the snus product 4 that can be perceived by the senses. In particular, the sensate substance may impart a flavour and/or an aroma to the snus product 4.

The openings 14 in the separating wall 9 may be the result of the separating wall 9 being comprised of a permeable, semi-permeable, porous or perforated material. In the case that the separating wall 9 is semi-permeable, the sensate substance may travel from the second chamber 11 to the first chamber 3 but other substances from the snus product 4 cannot travel from the first chamber 3 to the second chamber 11. Advantageously, this helps to maintain the freshness of the donor product 12 and prevents changes in the characteristics of the donor product 12 caused by substances that may be emitted by the snus product 4.

In one example, at the initial packaging stage of production of the snus product, both the snus and donor products 4, 12 are inserted into the first and second chambers 3, 11 of the container 1 respectively and the container 1 is closed by the main and secondary lids 8, 13. The container 1 may then be moved through further packaging processes, transport, storage and point-of-sale display during which time the volatile sensate substances released from the donor product 12 will homogenize between the first and second chambers 3, 11, thereby imparting a characteristic on the snus product 4. For example, if the donor product 12 releases an aroma or flavourant, the snus product 4 may be imparted with an organoleptic characteristic.

In another example, a consumer may purchase the container 1, which contains only the snus product 4 within the first chamber 3, and separately purchase a donor product 12 which can then be placed into the second chamber 11 to impart an organoleptic characteristic on the snus product 4.

This gives consumers control over what characteristics are imparted to the snus product 4 (which donor product they choose to buy) and at what time and for what duration (when they add the donor product to the second chamber and for how long), which will affect the intensity of the characteristic. Furthermore, different combinations of donor product may be placed in the second chamber 11, giving the consumer greater choice and opportunities for an even larger product range.

Figure 3:
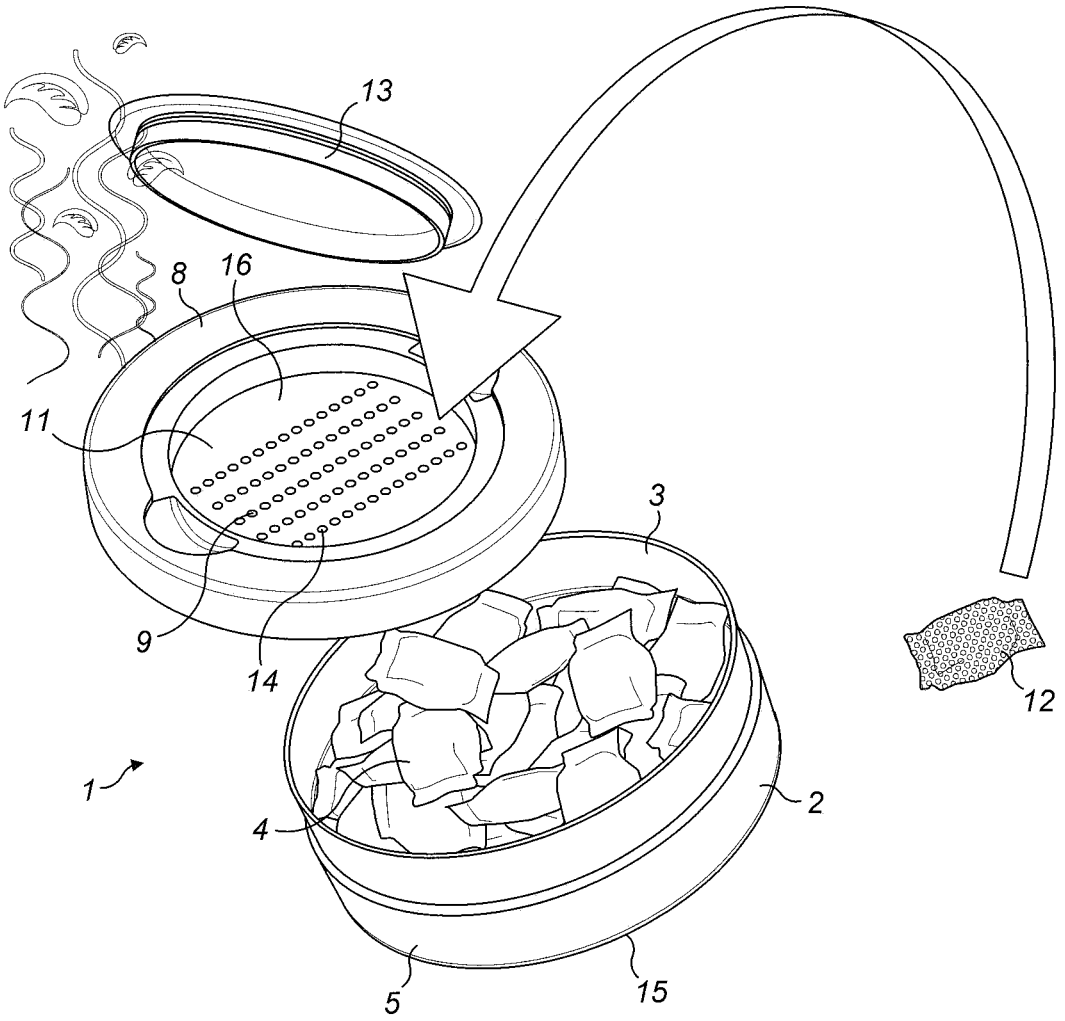
FIG. 3 shows an example of a container for snus tobacco having a second chamber formed in the lid.

FIG. 3 shows a container 1 with a cylindrical main body 2 that defines a first chamber 3 for receiving snus products 4, for example snus pouches as shown. In this example, a second chamber 11 for receiving a donor product 12 is formed within a main lid 8 of the container 1 which is attachable to the body 2 to sealably close the first chamber 3.

In the example shown in FIG. 3, the main body 2 is formed from a circular base wall 15 and an upstanding cylindrical side wall 5 and the first chamber 3 is within this space. The main lid 8 of the container 1 shown in FIG. 3 has a recess 16 that, when the lid 8 is attached to the body 2, protrudes into the space within the cylindrical side wall 5. This recess 16 defines the space for the second chamber 11. The bottom wall of the recess, facing into the first chamber 3, is a separating wall 9 configured to allow a transfer of a sensate substance from a donor product 12 received in the second chamber 11 to the snus product 4 in the first chamber 3. When the lid 8 is in position on the body 2, the second chamber 11 is separated from the first chamber 3 by a separating wall 9 formed in the lid 8. The wall 9 comprises a plurality of openings 14 that allow a sensate substance to pass from the donor product 12 to the snus product 4 while preventing movement of the snus product 4 and the donor product 12 themselves between the chambers 3, 11. The separating wall 9 may comprise a permeable, semi-permeable or porous material that allows the sensate substance to move through the separating wall 9. Alternatively, the separating wall 9 may comprise perforations 14 as shown in FIG. 3. In the case of a semi-permeable material, the separating wall 9 will allow the sensate substance to move from the second chamber 11 into the first chamber 3 but prevents substances moving from the first chamber 3 into the second chamber 11.

A secondary lid 13 is attachable to the first lid 8 to sealably close the second chamber 11 formed in the lid 8 and therefore seal the container 1.

Once a donor product 12 is placed in the second chamber 11 volatile sensate substances released from the donor product 12 can move through the openings 14 in the separating wall 9 and homogenize between the first and second chambers 3, 11, thereby imparting a characteristic to the snus product 4. If the donor product 12 is a flavourant or aromatic sensate substance then the snus product 4 may be imparted with an organoleptic characteristic.

It is noted that in FIGS. 1 and 2 and FIG. 3, the second chamber 11 of the container 1 has a secondary lid 13 which can be removed so as to open the second chamber 11, thus allowing a donor product 12 to be received by the second chamber 11. In alternative embodiments, the secondary lid 13 may be non-removable, having been attached to the container 1 and made non-removable during manufacture. This allows a donor product 12 to be inserted into the second chamber 11 during manufacture, but prevents a consumer from removing the donor product 12 at a later stage. This is advantageous if, for example, the donor product 12 is easily lost or scattered when the second chamber 11 is open.

Figure 4:
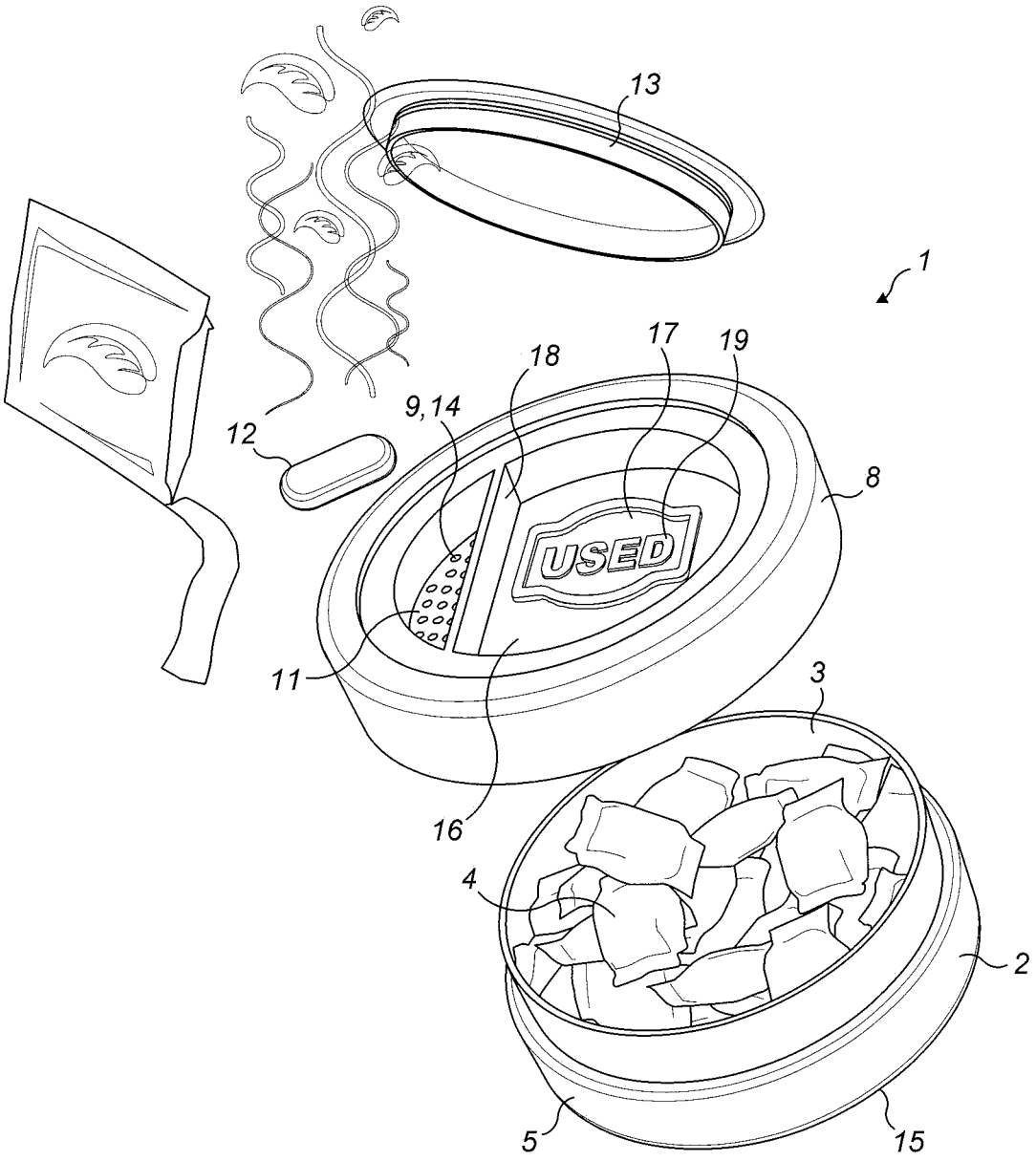
FIG. 4 shows another example of a container for snus tobacco having a second chamber formed in the lid.

FIG. 4 shows another example of a container 1 for snus products 4, similar to the example shown in FIG. 3, with a first chamber 3 formed within a cylindrical side wall 5 with a base wall 15 and being sealed by a main lid 8. In this example, the main lid 8 comprises a disposal chamber 17 for storing used snus products and a second chamber 11 for receiving the donor product 12.

The second chamber 11 and disposal chamber 17 are formed adjacent to each other within a recess 16 in the main lid 8 and are separated by a dividing wall 18. Both the disposal chamber 17 and the second chamber 11 are closed by a secondary lid 13 which removably attaches to the main lid 8. When the lid 8 is attached to the body 2 the second chamber 11 can communicate with the first chamber 3 via openings 14 in a separating wall 9 to allow sensate substances emitted from the donor product 12 to be transferred to the snus products 4 in the first chamber 3.

When the secondary lid 13 is attached to the first lid 8, the dividing wall 18 that separates the disposal and second chambers 17, 11 may create a seal between the disposal and second chambers 17, 11 such that substances can not transfer between the disposal and second chambers 17, 11. Alternatively, the dividing wall 18 may allow transfer of substances between the disposal and second chambers 17, 11 so that moisture can transfer from used snus in the disposal chamber 17 into the second chamber 11. This moisture may absorb a sensate substance emitted from the donor product 12 and move through the openings 14 in the separating wall 9 into the first chamber 3 to impart that sensate substance on the snus product 4. In this way, moisture from used snus placed in the disposal chamber 17 may increase the rate of substance transfer from the donor product 12 to the snus product 4.

In another example, the disposal chamber 17 and second chamber 11 may be formed in the bottom of the main body 2 of the container 1, instead of the in the main lid 8 as shown in FIG. 4. The recess 16 may protrude from the base wall 15 into the space within the side wall 5 and the disposal chamber 17, second chamber 11, separating wall 9, solid wall 19 and dividing wall 18 can each be defined there. In this example, the main lid 8 would be a simple sealed lid with no extra features.

Figure 5:
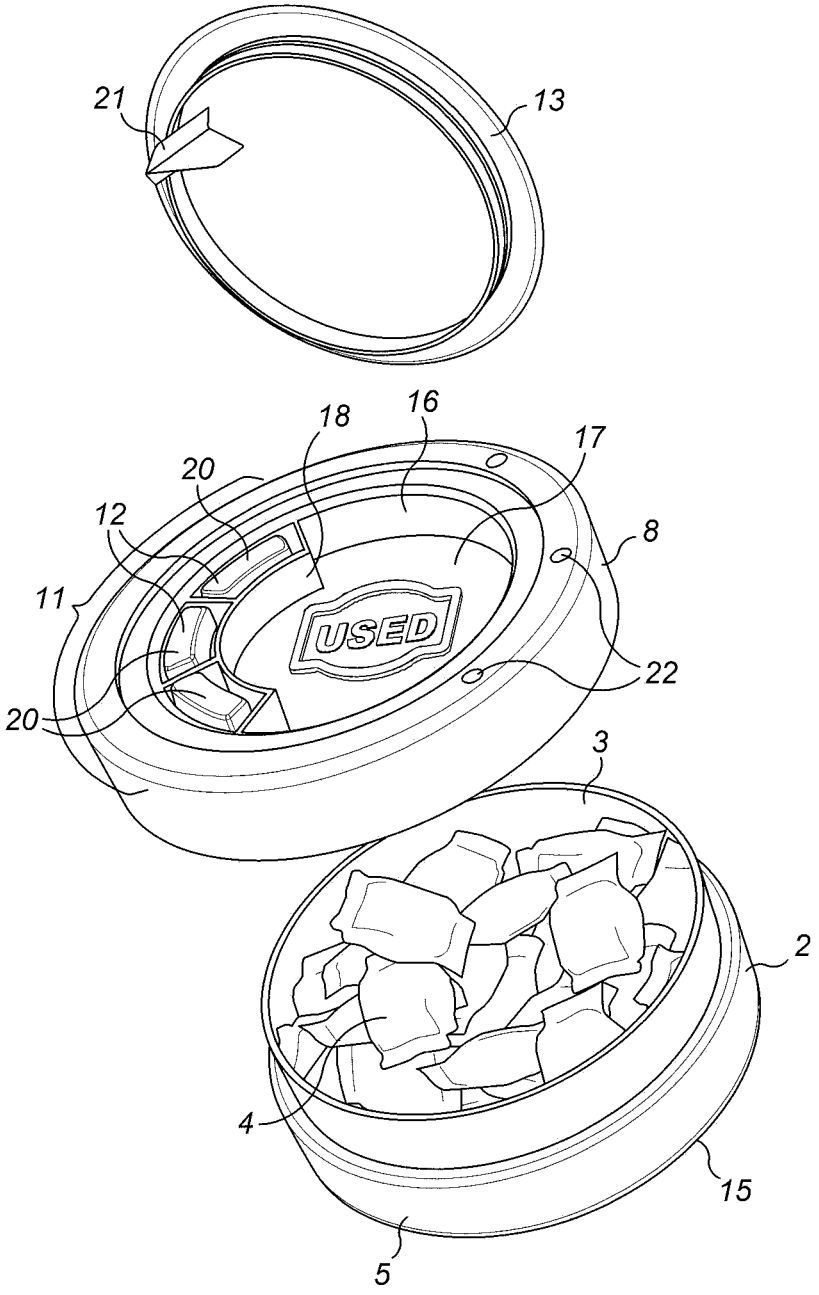
FIG. 5 shows an example of a container for snus tobacco having a second chamber which comprises sub-chambers.

FIG. 5 shows a similar container 1 to that shown in FIG. 4, with a disposal chamber 17 for used snus and a second chamber 11 for a donor product 12 formed in the main lid 8 of the container 1.

The main body 2 of the container is formed of a circular base wall 15 and an upstanding cylindrical side wall 5 which define the space for the first chamber 3.

In this example, the second chamber 11, which is adjacent to the disposal chamber 17, comprises several separate sub-chambers 20. In this example, the second chamber 11 is divided into three sub-chambers 20 that may each receive a different donor product 12, although the second chamber 11 may comprise any number of sub-chambers 20.

The donor products 12 in the different sub-chambers 20 may simultaneously transfer a sensate substance to the snus product 4 in the first chamber 3. Alternatively, a user may be able to select which donor product 12 is desired. For example, as show in FIG. 5, the donor products 12 may be capsules or tablets that must be burst open to release the sensate substance to be transferred to the snus product 4. A consumer is able to select different combinations of donor products 12 and therefore change the organoleptic characteristics imparted to the snus product 4. Also, this arrangement may be used to provide a refreshing effect through the life of the product. For example, a consumer can use one donor capsule 12 on first opening the container 1 and can use the others at later times to increase the organoleptic characteristic of the snus product 4 after the effects of the first capsule have subsided. Alternatively, the different sub-chambers 20 within the second chamber 12 may contain different strength donor products so that a user can select the desired strength of the characteristic to impart to the snus product.

As shown in FIG. 5, the first and secondary lids 8, 13 may be generally circular, to match the shape of the cylindrical main body 2, and the disposal chamber 17 and second chamber 11 together form a generally circular area within the recess 16 in the main lid 8. The sub-chambers 20 within the second chamber 11 are arranged circumferentially around an edge of the disposal chamber 17 so that the distance from the centre of the circular main lid 8 to each sub-chamber 20 is the same. The secondary lid 13, which closes the disposal chamber 17 and the second chamber 11, may comprise a pointer 21 that a user can push into a selected capsule 12 to burst that capsule and release the sensate substance. The desired sub-chamber 20 can be selected by turning the secondary lid 13 to a different angle relative to the main lid 8, thereby moving the pointer 21 from alignment with one sub-chamber into alignment with another sub-chamber. In this case, the main lid 8 of the container may be provided with markings 22 that assist a user in aligning the pointer 21 with the desired sub-chamber 20. When a user wants to close the disposal and second chambers 17, 11 with the secondary lid 13, without bursting a capsule, the secondary lid 13 can be turned to align the pointer 21 with the disposal chamber 17. In an alternative example, the secondary lid may not have a pointer and the user can manually burst the capsules.

The second chamber is separated from the disposal chamber 17 by a dividing wall 18 and similar dividing walls may divide the second chamber 11 into the plurality of sub-chambers 20. These dividing walls may seal the different areas to prevent transfer of any substances therebetween. Alternatively the dividing walls may allow moisture to move between the areas, for example from used snus in the disposal chamber 17 into the second chamber 11 to aid transfer of sensate substance to the first chamber 3.

In an alternative embodiment, similar to that shown in FIG. 5, the disposal chamber 17 and second chamber 11 with a plurality of sub-chambers 20 may be located in a recess in the base wall 15 of the main body 2, instead of in the main lid 8.

Figure 6:
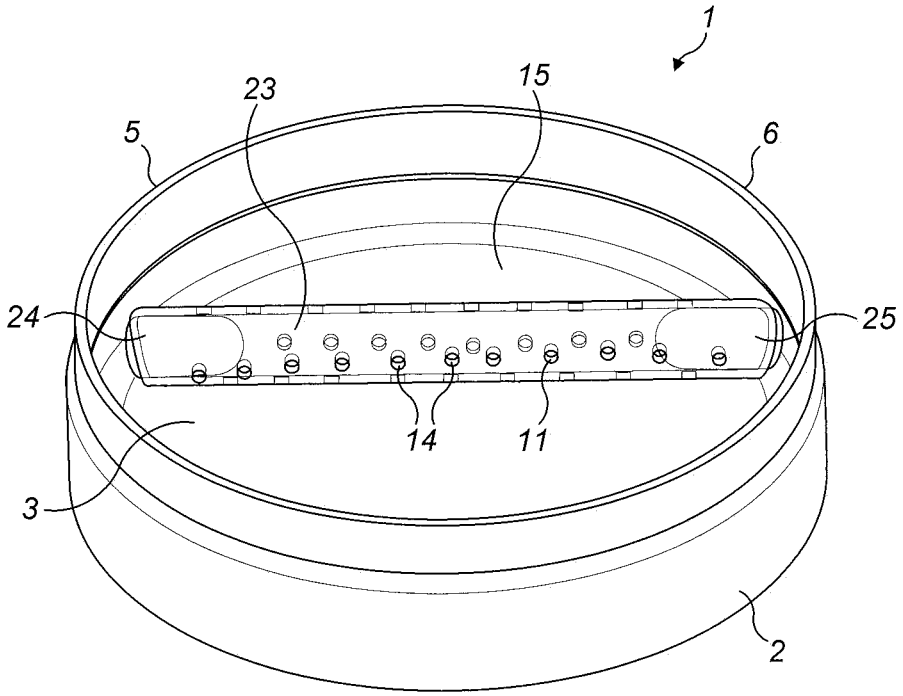
FIG. 6 shows an example of a container for snus tobacco having a second chamber formed within a first chamber.

FIG. 6 shows another example of a container 1 with a cylindrical main body 2 formed from a circular base wall 15 and an upstanding cylindrical side wall 5 that define a first chamber 3 for receiving a snus product. As with previous examples, a circular main lid (not shown) is attachable to the main body 2 to sealably close the otherwise open end 6 of the first chamber 3. In this embodiment, the container 1 also comprises an elongate cylindrical chamber 23 that extends across the first chamber 3, from one side of the upstanding side wall 5 of the main body 2 to an opposite side. The cylindrical chamber 23 is fixed to two points 24, 25 of the inside face of the side wall 5 of the main body 2, within the first chamber 3. The cylindrical chamber 23 is a second chamber 11 for holding a donor product and is formed of a hollow cylindrical body with a plurality of openings 14 that allow the interior of the second chamber 11 to communicate with the first chamber 3. In this way, when a donor product is received in the second chamber 11, a sensate substance may pass from the donor product, through the openings 14 and into the first chamber 3 to impart an organoleptic characteristic to the snus product. The body of the cylindrical chamber 23 may be made at least partly from a permeable, semi-permeable, porous or perforated material that allows a sensate substance to move from the second chamber 11 to the first chamber 3. In the case of a semi-permeable material, the sensate substance will be able to move from the second chamber 11 into the first chamber 3 but substances are prevented from moving from the first chamber 3 into the second chamber 11.

The elongate cylindrical shape of the second chamber 11 and its position within the first container 3, where it will be surrounded by the snus product, will increase the surface contact area and decrease the distance between the second chamber 11 and the first chamber 3, which may increase the rate of substance transfer from the donor product to the snus product.

It is noted that the elongate cylindrical chamber 23 could instead be a chamber of any other suitable shape. Furthermore, the elongate cylindrical chamber 23 (or alternative) can be fixed at more than two points of the side wall 5 and/or base wall 15. Advantageously, this means that the chamber 23 is fastened more securely to the container 1.

Figure 7:
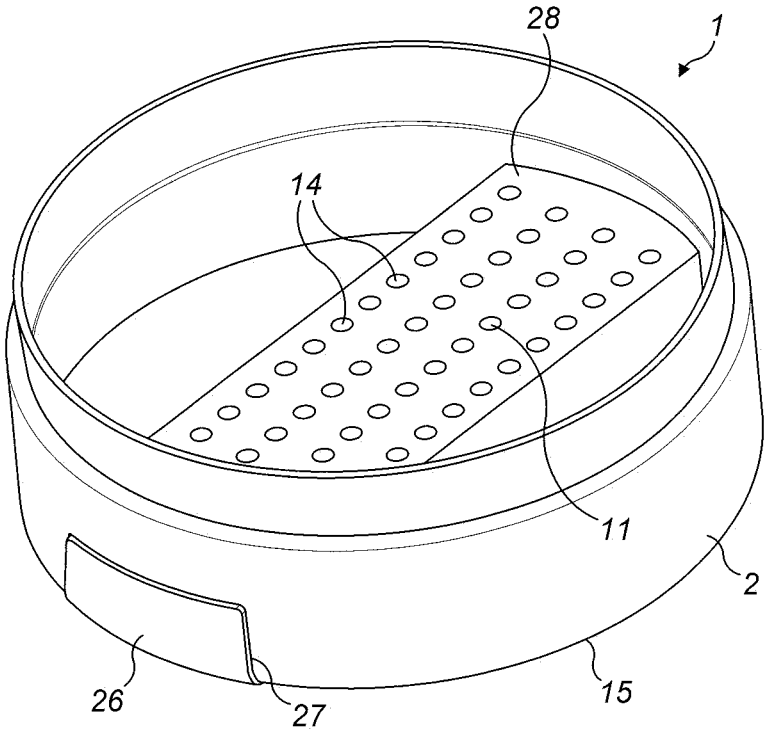
FIG. 7 shows an example of a container for snus tobacco having a second chamber in the form of a removable cartridge.

FIG. 7 shows another example of a container 1 for a snus product. This container 1 also has a cylindrical main body 2 which defines a first chamber 3 for receiving a snus product and a removable main lid (not shown) that sealably closes the first chamber 3. The example shown in FIG. 7 also has a second chamber 11 in the form of a removable cartridge 26 with an internal space defining the second chamber 11 for containing a donor product. The cartridge 26 is attachable to a recess 27 or opening within the base wall 15 of the main body 2, on the side opposite the main lid. The cartridge 26 may be attachable to the recess 27 or opening of the main body 2 by means of a catch or similar mechanism (not shown) that allows the cartridge 26 to be removed from the container 1.

The wall 28 of the cartridge 26 that faces the interior of the first chamber 3 when the cartridge 26 is received in the recess 27 has a plurality of openings 14 that align with an opening or a plurality of openings in the recess 27 in the base wall 15 of the main body 2. This allows a sensate substance to be transferred from a donor product in the second chamber 11 within the cartridge 26 to a snus product in the first chamber 3.

The cartridge 26 is removable to allow a user to insert the cartridge 26 when they desire the snus to have a different characteristic. Alternatively, the cartridge 26 can be changed when the donor product becomes ineffective or exhausted. The container 1 may be provided with a sealed cartridge or plate for attaching to the container to cover the openings in the recess when there is no cartridge attached to the container, ensuring the first chamber is sealed.

Different cartridges 26 may be available which contain different sensate substances. This allows the consumer to choose from a range of cartridges 26 so that different organoleptic characteristics can be imparted to the snus product. The cartridges may be sold with the container 1, or may be sold separately.

Figure 8:
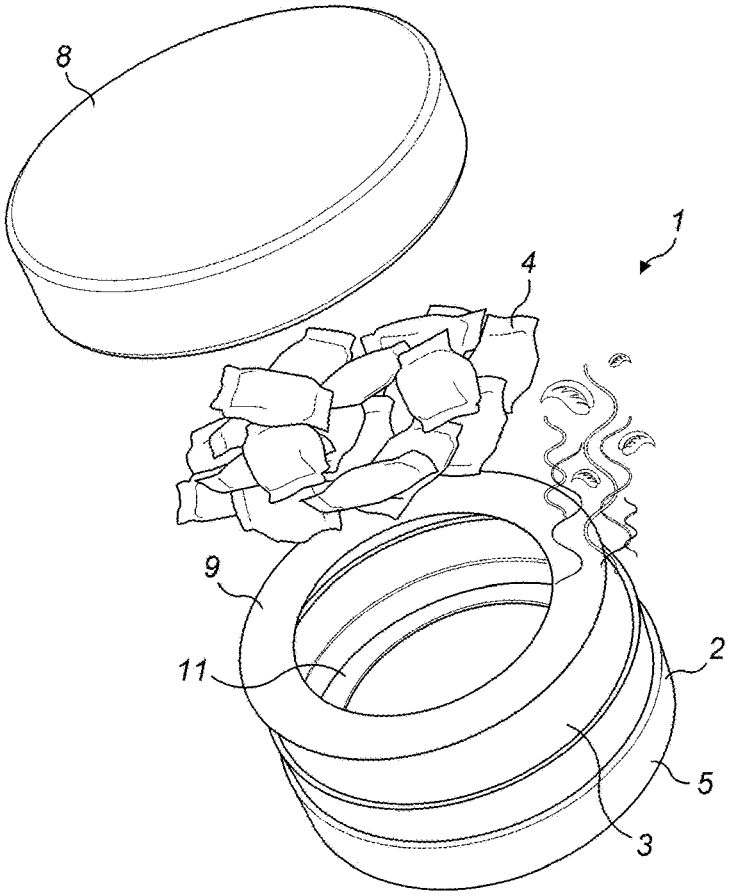
FIG. 8 shows an example of a container for snus tobacco having an annular second chamber formed within a first chamber; and, FIG. 9 shows a cross-sectional view of a part of the container of FIG. 8.
Figure 9:
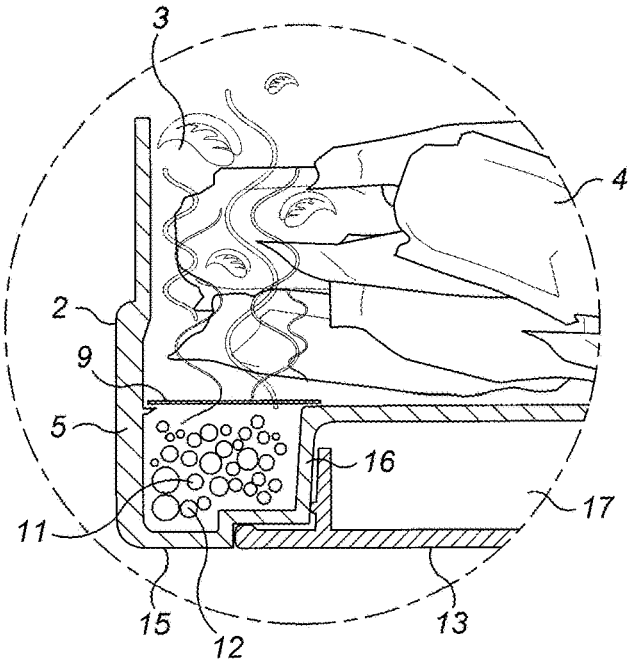

FIGS. 8 and 9 show another container 1 for snus products 4 comprising a cylindrical main body 2 that defines a first chamber 3 for receiving a snus product 4. As with previous examples, a removable main lid 8 sealably closes the first chamber 3. The container 1 of FIGS. 8 and 9 also has an optional disposal chamber 17 formed in a recess 16 in the bottom wall 15 of the main body 2 which is separated from the first chamber 3. In this example, the disposal chamber 17 is circular and the recess 16 protrudes into the first chamber 3 with a smaller circumference than the cylindrical side wall 5 of the main body 2, thereby defining an annular space within the first chamber 3 between the side wall 5 of the main body 2 and the disposal chamber 17. A separating wall 9 is insertable into the first chamber 3 to separate this annular space from the first chamber 3 and thereby define a second chamber 11 for receiving a donor product 12. The separating wall 9 may be ring-shaped, as shown in FIG. 8, or it may be circular and extend across the first chamber 3.

FIG. 9 shows a cross section of one side of the container 1 of FIG. 8 with the second chamber 11 located in the annular space between the side wall 5 of the main body 2 and the disposal chamber 17 formed in the recess 16 in the bottom wall 15 of the main body 2. The disposal chamber 17 has a removable secondary lid 13.

The second chamber 11 receives a donor product 12 and the separating wall 9 may have openings (not shown) that allow transfer of a sensate substance between the first and second chambers 3, 11. Alternatively, the separating wall 9 may be a layer of permeable, semi-permeable or porous material. The separating wall 9 separates the annular second chamber 11 from the first chamber 3 to prevent snus or donor products 4, 12 from moving between the chambers 3, 11, but does allow a sensate substance that is emitted from the donor product 12 to move from the second chamber 11 into the first container 3 to transfer an organoleptic characteristic to the snus product 4.

As explained earlier, the containers described with reference to the drawings can be provided with a snus product and a donor product during packaging so that the donor product imparts a characteristic on the snus product during the time before a consumer opens the container. Alternatively, the container may be packaged with only the snus product and the consumer inserts the donor product themselves, after which the donor product will impart a characteristic on the snus product.

It will be appreciated that the shape of the examples described with reference to FIGS. 1 to 9 may be altered without deviating from the invention defined in the claims. The examples described each have a cylindrical main body and generally circular components, however, the shapes of the main body and/or the chambers may be varied to be square, oblong, triangular or any other shape. Furthermore, the container may be pocket-sized to allow a user to easily carry the container but the container may alternatively be larger or smaller to hold more or less snus product.

The main and secondary lids of the examples described with reference to FIGS. 1 to 9 may or may not hermetically seal the first and second chambers of the containers. A hermetically sealed container will prevent moisture from escaping and maintain the moisture content of the snus, but a sealed container may cause the air and snus tobacco in the container to become stale. Preservatives or other active ingredients may be added to the container/snus to maintain freshness.

Although the containers shown in FIGS. 1 to 9 were described for use with snus pouch products, it will be appreciated that the containers may alternatively be used with other snus or smokeless tobacco products, either in loose form or packaged in permeable pouches. Furthermore, the containers may instead be used for other tobacco products, such as loose rolling tobacco. Also, non-tobacco products, such as inert materials with or without nicotine, or plant matter other than tobacco, could be used. The smokeless snus tobacco product (or alternative) contained in the first chamber 3 may be known as the recipient product.

Examples of possible donor products that may be used in the containers described with reference to FIGS. 1 to 9 to release a sensate substance and impart an organoleptic characteristic on the product may be organic sensate substances such as herbs or plants, for example eucalyptus or mint leaves. These organic substances may be treated to reduce the overall size and/or increase the intensity of the substance they emit. They may also be treated to release moisture and/or oils that carry the sensate substance to the product.

Another example of a donor product may be a polymer foam which is formed into the required shape and then exposed to a sensate substance which is absorbed by the foam. The sensate substance is retained and gradually released over time. The rate of release may be accelerated by warming the material.

Another example of a donor product may be a material comprised of cellulose so acetate fibres which absorb the sensate substance.

Another example of a donor product may be a botanical, absorbent material such as a wood material. Wood is naturally absorbent and any absorbed sensate substance would be gradually released. The wood may be a natural or processed wood. Another suitable botanical, absorbent material could be a tobacco material. Of course, the botanical, absorbent material such as the wood or tobacco may itself contribute to the sensate substance.

The sensate substance may be a volatile substance, such as an aromatic botanical substance. In this example, when the sensate substance is released or emitted from the donor product, the sensate substance evaporates and permeates the first chamber 3. When the evaporated sensate substance encounters a recipient product it will impart on that product an organoleptic characteristic.

Alternatively, the sensate substance may be a liquid which is gradually released from the donor product and is transferred to the products by contact. The liquid may be an oil or a solution which carries a substance which, when transferred to the recipient product, imparts an organoleptic characteristic to that product.

The sensate substance may provide a flavour to the recipient products 2. As used herein, the terms "sensate substance" and "flavour" refer to materials which, where local regulations permit, may be used to create a desired taste or aroma in a product for adult consumers. They may include extracts (e.g., eucalyptus, licorice, hydrangea, Japanese white bark magnolia leaf, chamomile, fenugreek, clove, menthol, Japanese mint, aniseed, cinnamon, herb, wintergreen, cherry, berry, peach, apple, Drambuie (distilled alcoholic liqueur having a Scotch Whisky base), bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus Mentha), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

Alternatively, the organoleptic characteristic may be an aroma, for example a menthol scent or other. A mentholated sensate substance may also create a cooling sensation when the infused product is consumed or used, as well as providing flavour and/or aroma. It will be appreciated that any combination of organoleptic characteristics may be provided by the sensate substance which may also act to provide an aroma to the air in the chamber, such that a consumer can smell the sensate substance on opening the container.

It is noted that, in embodiments, the first and second chambers 3, 11 may each be divided into any number of sub-chambers for storage of the recipient and donor products, respectively.

In the examples described above with reference to the Figures the donor product 12 emits a sensate substance to impart an organoleptic characteristic to the recipient products 4 in the container 1. However, it will be appreciated that the donor product 12 may alternatively emit any other substance which will impart any other characteristic to the recipient products.

For example, the donor product may emit a moisturising substance to provide the recipient products 4 with moisture. The moisturising substance emitted by the donor product 12 may be any substance that provides the recipient products 4 with moisture, for example a water-based solution or any other substance. Advantageously, moisture provided by the donor product 12 in this example will prevent the recipient products 4 becoming dry during storage in the container prior to purchase or after purchase. The moisturising donor product 12 may be placed in the container during packaging so that the consumer is presented with a fresh product on first opening. Alternatively, the consumer could place the moisturising donor product 12 in the container to impart moisture on the recipient products 4 after first opening to prevent the recipient products 4 from drying out after first opening of the container.

It will be appreciated that the donor product 12 may emit both a sensate substance and a moisturising substance, which may be a single substance or a combination of two or more substances. For example, the substance emitted may be a sensate substance which is water-based, or carried by a water-based substance, and therefore capable of providing both an organoleptic characteristic and a moisturising characteristic.

It will therefore be appreciated that the substance emitted by donor product may impart to the recipient product any characteristic which may be desirable, for example the substance may impart a characteristic of flavour, aroma, moisture content, quality or longevity or any other beneficial characteristic.

It should also be clear that, in embodiments, any number of recipient and donor products may be used.

In order to address various issues and advance the art, the entirety of this disclosure shows by way of illustration various embodiments in which the claimed invention(s) may be practiced and provide for superior containers. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A container comprising a main body comprising a base wall and upstanding side wall, a first chamber defined in a space within the main body, and a main lid removably attachable to the main body to close the first chamber, and a tobacco product within the first chamber, wherein the main lid comprises a recess that, when the main lid is attached to the container, protrudes into the first chamber and a second chamber is defined within said recess, and a secondary lid, the secondary lid being attachable to the main lid to close the second chamber, a wall of said recess being a separating wall configured so that at least one substance emitted by a donor product received in the second chamber is conveyed from the second chamber into the first chamber through said separating wall to impart a characteristic to the tobacco product in said first chamber, wherein the separating wall comprises a permeable or semi-permeable membrane through which the substance is conveyed, and wherein an opening of the recess is flush with a top surface of the main lid.

2. The container of claim 1, wherein the first chamber contains two or more tobacco products.

3. The container of claim 1, wherein the recess in the main lid comprises a disposal chamber and a dividing wall that separates the disposal chamber from the second chamber within the recess.

4. The container of claim 3, wherein the secondary lid forms a seal between the disposal chamber and the second chamber when the secondary lid is attached to the main lid.

5. The container of claim 3, wherein the secondary lid includes a protrusion configured such that when the secondary lid is attached to the container the protrusion extends either into the disposal chamber or into the second chamber.

6. The container of claim 3, wherein the second chamber comprises a plurality of sub-chambers.

7. The container of claim 6, wherein the sub-chambers are arranged circumferentially around an edge of the disposal chamber.

8. The container of claim 7, wherein the dividing wall is configured to allow moisture to move between the disposal chamber and the sub-chambers.

9. A container comprising a main body comprising a base wall and upstanding side wall, a first chamber defined in a space within the main body, and a main lid removably attachable to the main body to close the first chamber, wherein the main lid comprises a recess that, when the main lid is attached to the container, protrudes into the first chamber and a second chamber is defined within said recess, and a secondary lid, the secondary lid being attachable to the main lid to close the second chamber, a wall of said recess being a separating wall configured so that at least one substance emitted by a donor product received in the second chamber is conveyed from the second chamber into the first chamber through said separating wall to impart a characteristic to a recipient product in said first chamber, wherein the separating wall comprises a permeable or semi-permeable membrane through which the substance is conveyed, and wherein an opening of the recess is flush with a top surface of the main lid.

10. The container of claim 9, wherein the first chamber contains one or more recipient products.

11. The container of claim 9, wherein the second chamber contains one or more donor products.

12. The container of claim 9, wherein the recipient product is a snus tobacco product.

13. The container of claim 9, wherein the substance emitted by the donor product is a sensate substance to impart an organoleptic characteristic to the tobacco product or to a recipient product in the container.

14. The container of claim 9, wherein the substance emitted by the donor product is a moisturising substance to provide moisture to the tobacco product or to a recipient product in the container.

15. The container of claim 9, wherein the donor product is a non-tobacco organic substance.

* * * * *